US007204819B2

(12) United States Patent
Berger

(10) Patent No.: US 7,204,819 B2
(45) Date of Patent: Apr. 17, 2007

(54) GUARD STRUCTURE FOR PROTECTING THE LOWER LIMBS OF THE HUMAN BODY

(75) Inventor: Yann Berger, Asolo (IT)

(73) Assignee: Alpinestars Research SRL, Treviso (IT)

( * ) Notice: Subject to any disclaimer, the term of this patent is extended or adjusted under 35 U.S.C. 154(b) by 0 days.

(21) Appl. No.: 11/388,608

(22) Filed: Mar. 24, 2006

(65) Prior Publication Data

US 2006/0167396 A1 Jul. 27, 2006

Related U.S. Application Data

(63) Continuation of application No. PCT/EP2004/004659, filed on May 3, 2004.

(30) Foreign Application Priority Data

Sep. 26, 2003 (IT) ..... TV2003A000133

(51) Int. Cl.
*A61F 5/00* (2006.01)

(52) U.S. Cl. ..... 602/26; 602/27

(58) Field of Classification Search ..... 2/22, 2/911, 62, 255, 262; 602/20, 25, 65, 23, 602/26, 27

See application file for complete search history.

(56) References Cited

U.S. PATENT DOCUMENTS 4,868,926 A 9/1989 Lowson
5,009,223 A 4/1991 DeFonce
5,025,782 A * 6/1991 Salerno ..... 602/16
5,452,475 A * 9/1995 Hunt, Jr. ..... 2/22
5,807,294 A * 9/1998 Cawley et al. ..... 602/26

FOREIGN PATENT DOCUMENTS

DE 2 310 149 9/1974
DE 23 62 044 6/1975
EP 0 920 887 6/1999

OTHER PUBLICATIONS

International Search Report dated Aug. 30, 2004.

* cited by examiner

*Primary Examiner*—Danton D. DeMIlle
*Assistant Examiner*—K C Matter
(74) *Attorney, Agent, or Firm*—Katten Muchin Rosenman LLP

(57) ABSTRACT

Guard structure (10) for protecting a lower limb, comprising a number of substantially rigid members (14, 26, 32), which are adapted to be removably and adjustably applied on to the thigh and the calf of the user. These rigid members are connected with each other in such a manner as to allow for the length of the entire structure to be adjusted in accordance with the actual length of the limb, in particular of the calf, while keeping the rigid members themselves joined with each other. The lower end portion of the structure, which is intended for wearing under the usual garment, is anchored in an adjustable manner to a containment shell (52) for a shoe (36).

10 Claims, 2 Drawing Sheets

GUARD STRUCTURE FOR PROTECTING THE LOWER LIMBS OF THE HUMAN BODY

CROSS-REFERENCE TO RELATED APPLICATION

This application is a continuation of International Application PCT/EP2004/004659 filed on May 3, 2004, now International Publication WO 2005/030349, and claims priority from Italian Application Number TV2003A000133 filed Sep. 26, 2003, the contents of which are herein wholly incorporated by reference.

The present invention refers to a guard structure for the protection of the joints of the lower limbs of the human body, in particular the knee and the ankle. More specifically, the present invention relates to a removable structure that is adapted to be applied on to the lower limbs of a user, for the protection thereof, when performing activities, such as in particular sports practices and disciplines, which involve the lower limbs, and in particular the joints thereof, to be exposed to shocks and torsional stresses.

Typical examples of sports practices and disciplines, which reference is made to in this context, include motor-cycling and skiing, i.e. disciplines that involve not only very high racing speeds, but also a lot of manoeuvres and evolutions to be performed while racing, so that the lower limbs are subject to the above-mentioned kinds of stresses. In these cases, in fact, the risks of falling are very high and, in such circumstances, the lower limbs, and in particular the articulations thereof (i.e. the knee joints and the ankle joints), are subject to not only quite severe impacts and, as a result, quite likely fractures, but also twisting or torsional stresses that may give rise to quite serious injuries in terms of ligaments rupturing, i.e. breaking off, which, unlike fractures, may prove irremediable.

Although reference will be made throughout the following description to motor-cycling, meant as the riding of motor-cycles, in particular in racing competitions, it shall be appreciated that this reference is by no means intended to limit the scope of the present invention in any way, since it has been selected and is used merely for illustrative purposes.

In view of avoiding such painful events, sports equipment and fittings duly provided with guards have been developed throughout these years to the purpose of limiting, if not doing fully away with, the effects of impacts and accidents. Largely known in the art are such simple solutions as paddings, stuffings, bandages and the like, however of a generally unsatisfactory import as far as their actual protective effectiveness is concerned.

A prior-art approach to solving the problem of succeeding in protecting the knee against both lateral and torsional forces is described and illustrated in the Italian utility model publication no. 209703, which discloses a boot that embraces the foot and the calf of the wearer; the upper end portions of this boot, at both sides of the knee joint, are then connected to a strap to be tightened round the thigh. In this manner, the knee is allowed to bend, while trying to prevent it from undergoing not only twists, but also side displacements.

Another prior-art solution is the one disclosed in the U.S. Pat. No. 5,009,223, in which two retaining bands, which are designed to be anchored on to the thigh and the calf, respectively, are joined with each other in an articulated manner at the knee portion of the leg by means of a particular hinge arrangement that is adapted to allow the knee to move in as natural as possible manner. As this can be readily appreciated, this solution is by no way aimed at offering a protection to the ankle; moreover, it does not seem to include a protection effect to guard the knee against bumps and impacts.

Known in the art are also guarding means aimed at solely protecting the knee against frontally imparted impacts. These means generally consist of more or less rigid pads to be fastened in various manners round the knee itself or, usually, on the thigh and the shinbone. Solutions of this kind are for instance described in the U.S. Pat. No. 5,476,442 and No. 5,277,697.

Other known solutions to the above outlined problems can be found in U.S. Pat. No. 4,868,926, DE-A-2 310 149 and EP-A-0 920 887 where means are provided for the separable connection of a guard strructure to a footwear.

However, all above-indicated solutions have a number of drawbacks. In the first place, they seem to forget the need for the ankle joint to be offered adequate protection, considering that the ankle joint itself is exposed to dangerous stresses to a certainly not lesser extent than the knee, especially in the case of accidents. In addition, the knee is usually protected against torsional stresses, i.e. twists, but nothing is done to protect it against bumps and shocks, or vice-versa, as this occurs for instance with the solution proposed in the U.S. Pat. No. 5,009,223, in which the above-indicated articulated splints are placed at the sides of the knee, while leaving the front portions thereof fully uncovered and unprotected, so that the entire zone of the rotula, or kneecap, and the meniscus is fully and easily exposed to traumas or fractures.

Finally, all of the afore-mentioned guarding means prove rather difficult to customize, i.e. personalize, so that they require an almost perfect correspondence between factory model, i.e. the item as it is made at the factory, and physical structure of the wearer, with readily appreciable disadvantages for both the manufacturer and the user.

It therefore is a main object of the present invention to provide guarding means that are capable of doing away with these drawbacks and disadvantages of prior-art solutions by at the same time and in the same manner protecting the joints of the entire lower limb, i.e. both the knee and the ankle joints, against dangerous stresses of all kinds, i.e. both impacts and twists.

Within such general object, it is another purpose of the present invention to provide guarding means that can be used universally and are easily adapted to the actual bodily structure of the wearer.

These aims are reached in a guard structure for the protection of the lower limbs of the human body, which comprises two essentially rigid and convex-shaped members, which are adapted to be fastened, by means of releasable and adjustable straps, to the thigh and the calf, respectively, in a manner so as to be able to be loosened and removed, and an articulated joint connecting said two members with each other, so as to allow the limb to freely bend at the knee joint, said structure being provided with an extension piece that is adapted to be connected in a separable manner to the footwear being worn by the user and, according to the present invention, consists of an essentially rigid third member that is also provided in a convex shape to embrace the lower portion of the calf, immediately above the ankle.

In a preferred embodiment of the present invention, the above-indicated extension piece of the guard structure is connected on the one side, i.e. at its upper end portion, with said second member adapted to be fastened on to the calf, and on the other side, i.e. at the lower end portion thereof, with either the footwear itself or a containment shell designed to removably accommodate said footwear, the connection of said third member with the second member or the footwear being such as to allow for a relative displacement in order to be able to adjust the overall length of the guard structure to the actual length of the limb to be protected and, in particular, the length of the calf portion thereof.

In a still more preferred embodiment of the present invention, said third member is connected to said second member with the aid of releasably lockable means that allow for a relative displacement of said third member with respect to said second member, thereby increasing the length of the tibial portion of the guard structure itself.

Referring again to the above-mentioned most preferred embodiment of the present invention, the lower end portion of said third member is so shaped as to feature two wings that divaricate to form a kind of fork, the end portions of these wings being attached, in a manner as to be able to be released and removed, to a substantially rigid shell intended for accommodating, again in a removable manner, a footwear, this shell being formed by two portions, i.e. boot-leg portion and an under-heel portion, respectively, connected to each other through a pair of articulated-connection splints, the end portions of said fork being in turn attached to said boot-leg portion of said shell in such a manner as to be capable of being adjusted and released.

The entire guard structure is designed so as to be worn under the usual garments provided for wearing in connection to the particular activity being carried out. This aspect further contributes to making the guard structure of the present invention fit for use on a still wider basis in all situations requiring an effective protection to be ensured to the legs; moreover, this certainly facilitates the introduction of the foot in the footwear.

Features and advantages of the present invention will anyway be more readily understood from the description of a preferred, although not sole, example of embodiment that is given below with reference to the accompanying drawings, in which.

Figure 2:
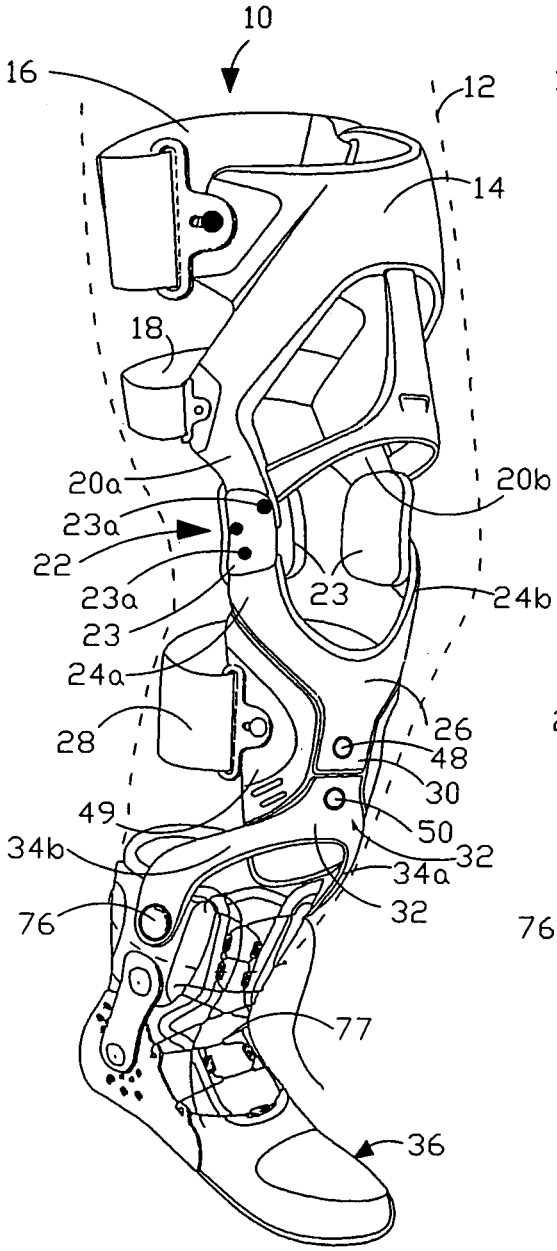
FIG. 2 is a view similar to the one appearing in FIG. 1, however with the knee protecting cap removed in order to expose the underlying mechanical articulation to view.
Figure 1:
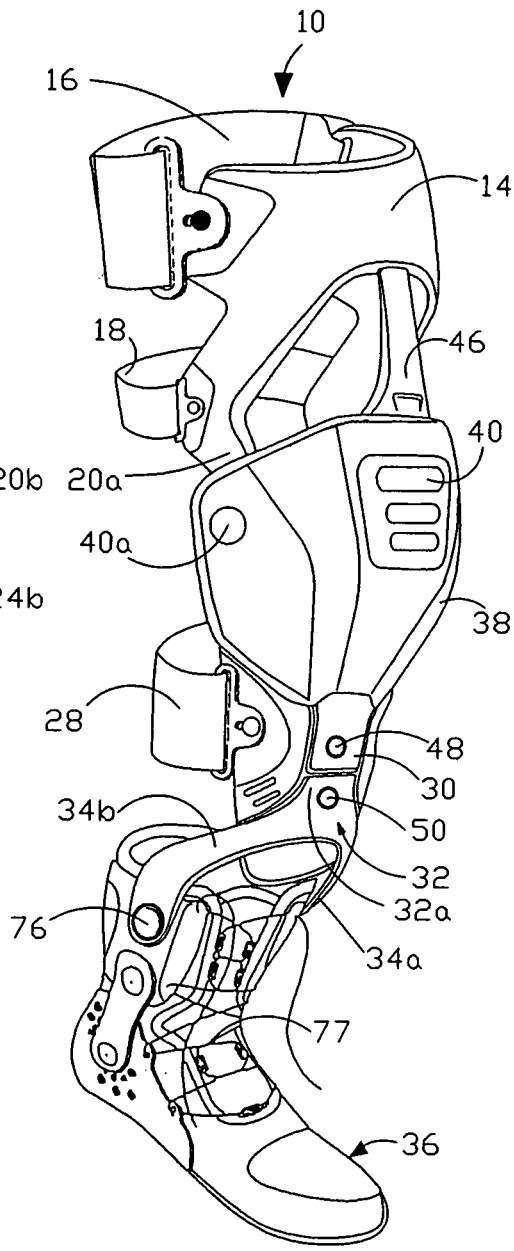
FIG. 1 is an overall view of the guard structure of the present invention.

Referring to FIGS. 1 and 2 in the first place, the reference numeral 10 is used there to generally indicate the entire guard structure, whereas the dashed line 12 in FIG. 2 is used to schematically indicate the outline of the trousers/sports suit, under which the guard structure can be worn. This guard structure comprises a first rigid bearing member 14 that is appropriately curved so as to be able to fit against the front portion of the thigh, to which it is applied in such a manner as to be capable of being removed by means of two releasable straps 16 and 18, whose length can be adjusted according to the actual circumference of the thigh of the wearer. At the lower end portion thereof, this member 14 is provided with two wings 20*a* and 20*b* extending downwards, first to the back and then to the fore, and ending approximately at the axis of rotation of the knee articulation.

As this can most clearly be seen in FIG. 2, the bearing member 14 is strengthened by the provision of a stiffening rib 46 having a substantially triangular convex shape, which joins the main body of said bearing member 14 to the two wings 20*a* and 20*b* thereof.

The end portions of these wings 20*a* and 20*b* are hinged via the articulated joint 22 on to the end portions of corresponding wings 24*a* and 24*b* of a second rigid bearing member 26, which is also provided in a convex shape and is intended to embrace the upper portion of the calf at a point immediately below the knee. Said articulated joint is preferably provided by sandwiching the wings 20*a* and 24*a* between two rigid elements 23 and hinging them to said elements by means of pins 23*a*.

The bearing member 26 terminates downwards with a protrusion 30 that is provided externally with cogs 30*b* adapted to engage, in a rack-like manner, corresponding cogs 32*b* provided on a third bearing member 32, as this shall be described in greater detail further on. Coupled to said bearing member 26 there can further be a shin-guard member 49 of an either soft or rigid material. For fastening the bearing member 26 there is provided a strap 28, which is adapted to be tightened in a releasable manner and is adjustable in accordance with the actual circumference of the calf portion to which it has to be fastened. This strap 28 may also be anchored to the guard member 49, as illustrated in FIGS. 1 and 2.

The above-mentioned third bearing member 32 is also provided in a convex shape, so as to be able to embrace the lower front portion of the calf of the wearer, and terminates with two wings 34*a* and 34*b* diverging from each other in a fork-like manner and adapted to be removably and adjustably fastened to the upper end portion of a boot or footwear 36, as this shall be explained in greater detail further on.

The following solution may be used to couple said third bearing member 32 with said second bearing member 26. Corresponding to the protrusion 30 of said second bearing member 26, the third bearing member 32 is provided with a planar portion 32*a* bearing the afore indicated cogs 32*b* and lying above the opposite cogs 30*b* provided in the outer surface of the protrusion 30 of the second bearing member 26, so as to matingly fit together. These cogs 32*b*, 30*b* are provided with a through-guide 31 for the insertion of a bolt or a rivet 31*b* adapted to tighten the bearing members 32 and 26 against each other and, as a result, to lock said bearing members 32, 26 in the relative position thereof. Another variant, illustrated in FIGS. 1 and 2, consists in placing the rack on the guard member 49 and fastening the two cogged patterns—which are both internal in this case—provided on the end portions 30, 32*a* thereupon, using known methods or even the same method as the one described in connection with the example considered above.

In this manner, it is possible for the distance of the lower end portion of the second bearing member 26 from the third bearing member 32 to be increased, thereby adjusting it to the actual length of the tibial portion or calf of the wearer. Locking both bearing members 26 and 32 in the desired relative positions may also be for instance obtained by tightening two grub screws as generally indicated at 48 and 50 in the Figures.

FIG. 1 clearly shows how a bowl-shaped guard cap 38, which is preferably made of a rigid plastic material and is possibly provided on its front side with a louvered aluminium portion 40, is mounted so as to apply on to the knee. This guard cap 38 is preferably attached to the articulated joint 22 by means of a pin 40*a*.

Figure 3:
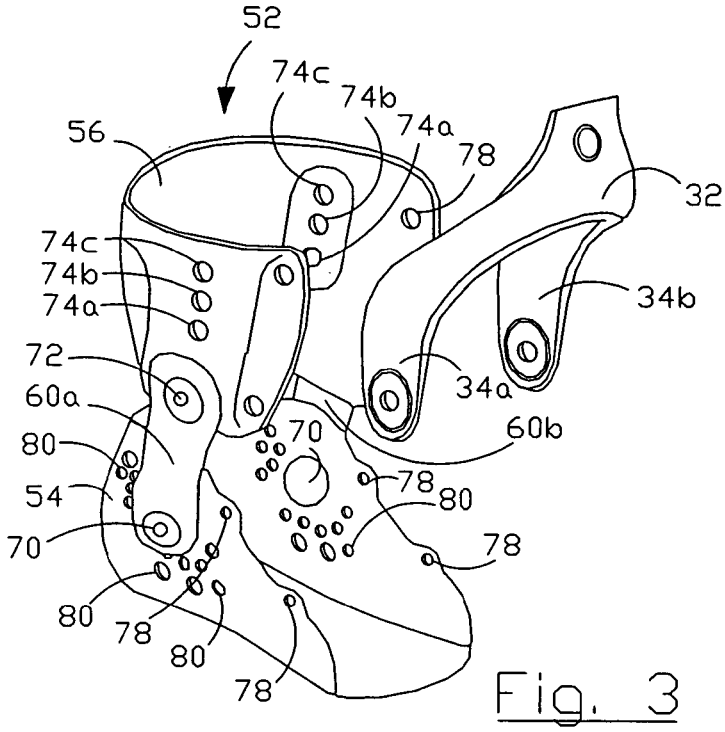
FIG. 3 is an exploded view of the ankle guard.
Figure 4:
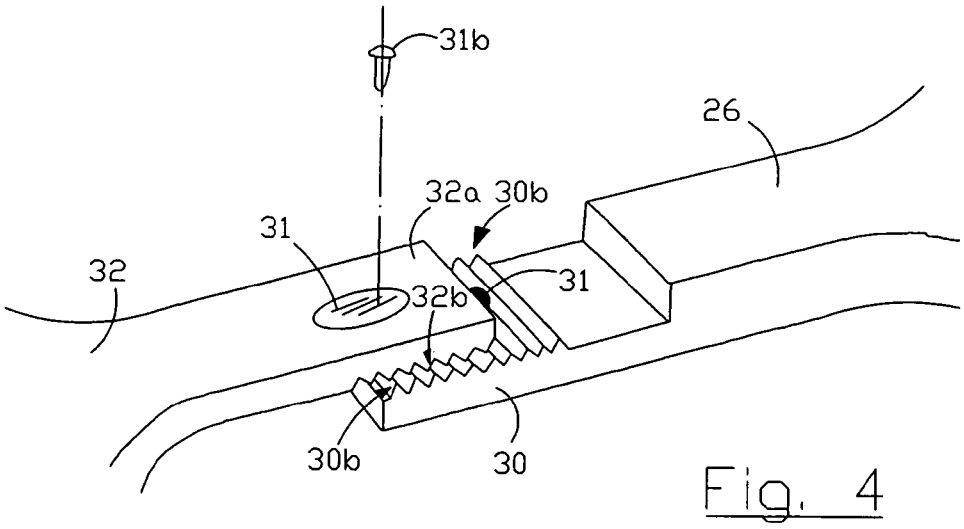
FIG. 4 is a detail view of the connection allowing the guard structure to be adjusted at the tibial portion thereof.

FIG. 3 illustrates a preferred embodiment of the connection of the leg guard structure to the footwear.

Provided is in this case a shell, as generally indicated at 52 as a whole in the Figure, which is made up by two portions, i.e. an under-heel portion 54 and a boot-leg portion 56, respectively, that are joined with each other by means of two articulated side splints 60*a* and 60*b* and hinged by means of the pins 70 and 72 on to said under-heel portion 54 and said boot-leg portion 56.

These two portions are made of a rigid material, such as a rigid plastic material, and, as this is clearly shown in FIG. 3, are provided with a plurality of adjustment perforations that will be explained more closely below.

In the upper part of the boot-leg portion 56 (which is open on the front side in the same manner as the under-heel portion 54) there are provided two sets of vertically arranged perforations 74*a*, 74*b* and 74*c*, to which the end portions of the wings 34*a* and 34*b* of the third bearing member 32 are attached. To this purpose, said end portions of the wings 34*a* and 34*b* are in turn provided with a hole intended to mate with a selected one of the perforations 74, into which there is then inserted a check pin 76 (FIGS. 1 and 2), preferably of the screw type completed by a lock-nut.

As illustrated in FIGS. 1 and 2, the shell 52 forms the accommodation for a usual shoe 36, which is held in position with the help of means known as such in the art or by means of a peculiar kind of lacing 77 according to the present invention, which engages holes 78 provided in the opposite flaps of said under-heel and boot-leg portions of the shell 52.

As far as the adjustment perforations 80 are concerned, these are intended to allow for the optimum position to be selected for the lower end portion of the respective articulation splint 60*a* and 60*b* to be inserted therein in accordance with the actual size of the shoe 36; they are further intended to ensure aeration.

It is worth noticing that the bearing members 14, 26 and 32, as well as the stiffening rib 46 are preferably made of an appropriate rigid plastic material, possibly reinforced with glass or carbon fibres; however, use can be made also of other materials, such as for instance aluminium, to such purpose.

The leg guard structure according to the present invention as described above can be embodied in a number of different, but conceptually equivalent manners that fall within the scope of the present invention.

In a first variant of the afore described embodiment, the possibility is contemplated to do without the above-described shoe accommodating shell 52 by instead letting the two wings 34*a* and 34*b*, which in this case would extend farther vertically downwards, be directly coupled to the sides of the shoe, in a line with the malleolar projections. To such purpose, fastening means will be of course provided to allow the end portions of these two modified wings to be fastened on to the body of the shoe. Alternatively, these two modified wings may be inserted for fastening in two pockets, or similar receptacles, formed in the thickness of the side walls of the shoe.

A solution of this kind may prove useful especially in the case of shoes or footwear 36 of a rigid kind, such as for instance skiing boots or motor-cycling rigid boots, i.e. a kind of footwear that makes use of a rigid outer shell enclosing the inner shoe provided to receive the foot of the wearer.

According to another variant of the afore-described embodiment, this calls for the adjustment of the length of the tibial portion of the leg guard structure, i.e. the one occurring at the point where the bearing members 26 and 32 join together, to be omitted. This adjustment, which in any case is absolutely necessary and, therefore, must be somehow provided, would in this case be left solely to the means provided for fastening the lower end portion of the bearing member 32 to the shell 52 accommodating the shoe 36, or to the above-noted alternatives thereto.

Such solution is feasible when the length adjustment is anyway limited to just a few centimetres, e.g. to such an extent as allowed for by the arrangement of the perforations 74*a*, 74*b*, and 74*c*.

From the description given above, and the considerations set forth therein, it may therefore be readily inferred that the present invention is actually capable of reaching all of its aims as set forth hereinbefore.

In particular, the leg guard structure ensures a fully adequate protection of both ankle and knee joints against twists, i.e. torsional stresses, while ensuring protection against impacts not only to the above-mentioned joints, but also to such parts of the leg as the tibia, which are particularly likely to incur fractures when subject to violent bumps and impacts.

At the same time, the leg guard structure of the invention is readily and easily adjusted to fit the actual bodily structure of each individual wearer, under clear advantages even from an industrial production viewpoint.

It should be finally noticed that, although not described in detail, the inner surfaces of the various rigid bearing members of the structure are contemplated to be lined with appropriate padding means for an increased comfort in use.

Although the invention has been described with reference to a preferred embodiment and some variants thereof, it will be readily appreciated that a number of modifications may be added or introduced by those skilled in the art without departing from the scope of the present invention, such as defined in the following claims.

The invention claimed is:

1. Guard structure for the protection of the lower limbs of the human body, of the kind comprising a first substantially rigid bearing member (14) and a second substantially rigid bearing member (26), both of them being provided in a convex shape to matingly fit against a front surface of a thigh and the upper portion of a calf, respectively, said rigid bearing members being adapted to be removably fastened by fastening straps adjustable in their length on to the thigh and the calf and being joined to each other by joint-like articulation means (22) having an axis that substantially coincides with the articulation axis of the knee, the structure also comprising means ensuring a separable connection of said second bearing member (26) to a footwear (36), characterized in that said means ensuring a separable connection between said second bearing member (26) and said footwear (36) consists of a third substantially rigid member (32), which is also provided in a convex shape so as to be able to embrace the calf portion lying close to the ankle, said third member comprising two wings (34*a*, 34*b*), diverging from each other in a fork-like manner and extending downwards, the end portions of said wings being adapted to be removably and adjustably connected to said footwear (36).

2. Guard structure according to claim 1, characterized in that it further comprises cogged means adapted to cooperate with each other in a rack-like manner and provided between a lower end portion of said second bearing member (26) and an upper end portion of said third member (32) so as to allow said third member (32) to be displaced downwards relative to said second member (26), while keeping said members (26) and (32) rigidly joined to each other.

3. Guard structure according to claim 2, characterized in that it further comprises means (48, 50) for releasably locking said cogged means in each adjustment position thereof.

4. Guard structure according to claim 1, characterized in that said wings (34*a*, 34*b*) of said third bearing member (32) are removably attached at free ends thereof to a substantially rigid containment shell (52) adapted to temporarily accommodate said footwear (36).

5. Guard structure according to claim 4, characterized in that said containment shell (52) consists of an under-heel portion (54) and a boot-leg portion (56) that are joined with each other by articulated connection means (60*a*, 60*b*, 70, 72), said boot-leg portion (56) being provided in each one of two flaps defining a front opening thereof with a plurality of perforations (74) spaced from each other by pre-established differing distances with respect to an upper edge of said boot-leg portion, said end portions of said wings (34*a*, 34*b*) being capable of being releasably fastened to selected pairs of said perforations (74).

6. Guard structure according to claim 5, characterized in that said articulated connection means between said under-heel portion (54) and said boot-leg portion (56) consist of splints (60*a*, 60*b*), which have their end portions hinged on by means of a pin (72) to said boot-leg portion and by means of a pin (70) to said under-heel portion (54), respectively, and in that said under-heel portion is provided with a plurality of perforations (80) for said pin (70) to be adjustably attached thereto.

7. Guard structure according to claim 1, characterized in that it further comprises means (38) of a rigid material to protect the knee against impacts, said means (38) being removably attached to said joint-like articulation means (22).

8. Guard structure according to claim 7, characterized in that said means (38) to protect the knee against impacts consist of a convex-shaped cap adapted to enclose, under no contact therewith, a front surface of the knee between the bearing members (14) and (26).

9. Guard structure according to claim 1, characterized in that said first bearing member matingly fits against the front surface of the thigh is provided with a pair of wings (20*a*, 20*b*) diverging from each other into a fork starting from the body of the member (14) and extending first rearwards and then forwards so as to have the end portions engaging the joint (22) lying in a line with the articulation axis of the knee.

10. Guard structure according to claim 5, characterized in that said under-heel portion (54) and said boot-leg portion (56) are provided along the front periphery thereof with a plurality of holes (78) adapted to hold and retain a lacing (77) of the footwear (36).

* * * * *